United States Patent [19]

Herfeld

[11] 4,061,275

[45] Dec. 6, 1977

[54] CONTINUOUS MIXING APPARATUS, ESPECIALLY COOLING MIXER AND A METHOD FOR PRODUCING GRANULATED MATERIAL

[76] Inventor: Friedrich Walter Herfeld, Wall 1, 5982 Neuenrade, Germany

[21] Appl. No.: 720,201

[22] Filed: Sept. 3, 1976

[51] Int. Cl.[2] ..... B02C 23/36

[52] U.S. Cl. ..... 241/46.04; 241/65; 366/144; 366/314

[58] Field of Search ..... 241/46.04, 46.11, 46.17, 241/65, 79, 79.3; 259/6

[56] References Cited

U.S. PATENT DOCUMENTS

| | | | |
|---|---|---|---|
| 3,171,604 | 3/1965 | Conley et al. | 241/65 |
| 3,243,128 | 3/1966 | Tight | 241/65 |
| 3,305,180 | 2/1967 | Tomlinson | 241/46.11 |
| 3,713,594 | 1/1973 | Blakley et al. | 241/46.17 |

*Primary Examiner*—Granville Y. Custer, Jr.

[57] ABSTRACT

The mixing apparatus comprises a mixing container with vertical axis which mixing container comprises an interior space and an outer annular space, communicated with the interior space by an annular gap. Within the interior space, there is performed a size reduction of the material to be mixed into granulated material which enters the outer annular space through the annular gap. The annular gap has comb-like openings so that only parts of small size are allowed to pass through.

12 Claims, 4 Drawing Figures

12"
12a
12b
22

1
2
3
4
5
6
7
8
9
12
13
14
15
16
17
19
20
21
31
32

CONTINUOUS MIXING APPARATUS, ESPECIALLY COOLING MIXER AND A METHOD FOR PRODUCING GRANULATED MATERIAL

BACKGROUND OF THE INVENTION

The invention relates to a continuous mixing apparatus having a mixing container with vertical arbor and having a centrifugal agitator shaft with stirring wings near the bottom of the apparatus.

The batchwise addition of the fundamental component of a mixture is of advantage in many cases. If a continuous discharging of the finished mixture (fully compounded stock) for subsequent processing stations is required, then there is the problem of buffering, i.e., providing a reservoir from which a uniform quantity per unit time is discharged.

SUMMARY OF THE INVENTION

It is the object of the present invention to provide a continuous mixing apparatus constructed in such a manner that in spite of batchwise input of the mixture fundamental component a continuous and homogeneous discharging of the finished mixture is secured.

According to the invention this object is solved in that the mixing container is subdivided, by a concentric ring wall extending from the cover to the bottom wall, into an interior space for the batchwise receiving of the fundamental components of the mixture and into an outer annular space into which the small (fine) components are passed for the mixing and for the discharging of the finished mixture, and that the stirring wings carry a rotor ring arranged oppositely to the ring wall which rotor ring forms a terminating gap with the lower face edge of the ring wall.

Generally, the present invention provides a continuous mixing apparatus comprising a mixing container having a container bottom. A concentric ring wall is disposed within the container and divides it into an interior space whose outer periphery is defined by the ring wall, and an outer annular space whose inner periphery is defined by the ring wall. The ring wall terminates in a bottom edge thereof disposed above the container bottom. A feeding nozzle is in flow communication with the interior space to introduce mixture components therein and a discharge opening means leads from said outer annular space. A central agitator shaft supports mixing wings for rotation within the interior space adjacent the container bottom. A rotor ring is carried by said mixing wings at a location radially spaced from the central shaft and disposed adjacent the bottom edge of the ring wall to define with it a gap of selected width disposed above the container bottom and radially spaced from the shaft. In this manner, mixture particles of a size not greater than the width of the gap are passed, by rotation of the wings, from the interior space to the outer annular space for removal therefrom via the discharge opening.

Certain objects of the invention are attained by providing a comb-like configuration to the gap by means of vertically projecting members projecting across the gap. Additionally, cooling means may be provided, for example, cooling conduits may be disposed in selected portions of the apparatus provided with double walls, to constitute the apparatus a cooling-mixing apparatus. Preferably, the volume of the interior space is equal to that of the outer annular space and a separate comminutor may be provided in the interior space. By this configuration of the mixing apparatus, it has a high capacity for a charge or feed within the interior space. This interior space serves as a buffering space. The material to be mixed enters the outer ring space into which a continuous addition of the small components is possible. A uniform and homogeneous distribution thereof within the discharged finished mixture is guaranteed, if the quantity discharged per unit of time is kept constant; this may be effected by, e.g., a discharge sluice.

It is effected by the gap that a size reduction of the material to be mixed is guaranteed since it is not possible for larger agglomerations to pass the gap. However, to guarantee a more precise determination of the size of the particles passing through the gap, it is provided by one aspect of the invention that the ring wall comprises at the bottom side a comb-like configuration extending approximately over the opening of the annular gap, and/or the rotor ring comprises a comb-like configuration extending approximately over the opening of the annular gap. In particular the comb-type configuration has the shape of a crown of pins as shown in the drawings. Thereby approximately square or rectangular passage openings are provided within the gap so that only granules of the predetermined size are allowed to enter the outer annular space. Thus, it is assured that the cooled material to be mixed is reduced in size to a sufficient extent.

A preferred embodiment of the invention relates to a cooling mixer for the production of a thermoplast preparation and is characterized in that a separately driven shaft having comminution blades projects into the mixing container.

The charge heated up within a heating mixer enters the interior space of the cooling mixer where same is maintained at a temperature above the lower limit of the softening range so that a proper size reduction of agglomerations is made possible. Thus, a premature cooling of the charge below the softening range is avoided. If the agglomerates are cooled down to a temperature below the softening range, actually size reduction thereof is scarcely possible. The agglomerates which are kept within the particle size as predetermined by the gap width are adapted to reach an outer annular space where an intensive cooling is performed to a temperature below the softening range of the mixture. The volume of the outer annular space is approximately the same as that of the interior space, but the outer annular space has a considerably larger surface for geometrical reasons so that intensive cooling is achieved.

As a further development it is proposed by the invention a method of producing agglomerates having limited particle size of a thermoplastic preparation, according to which method a heated and charge-capable material to be mixed from the thermoplast preparation is reduced in size within a central interior space during a mixing and cooling step. This method is characterized in that the material to be mixed is initially precooled within the interior space, where the size reduction is performed, to a temperature above the lower limit of the softening range, that the material to be mixed passes through a gap having a comb-like opening for the limitation of the particle size into an outer annular space having a larger surface, and that within the outer annular space an intensive cooling is carried out.

In order to be able to adapt the mixing apparatus to the specific particle size of the mixture, the invention provides means for the adjustment of the width of the terminating gap.

BRIEF DESCRIPTION OF THE DRAWINGS

One embodiment of the invention will be described in the following with reference to the attached drawings.

DESCRIPTION OF A PREFERRED EMBODIMENT

Figures 1, 3, 3A:
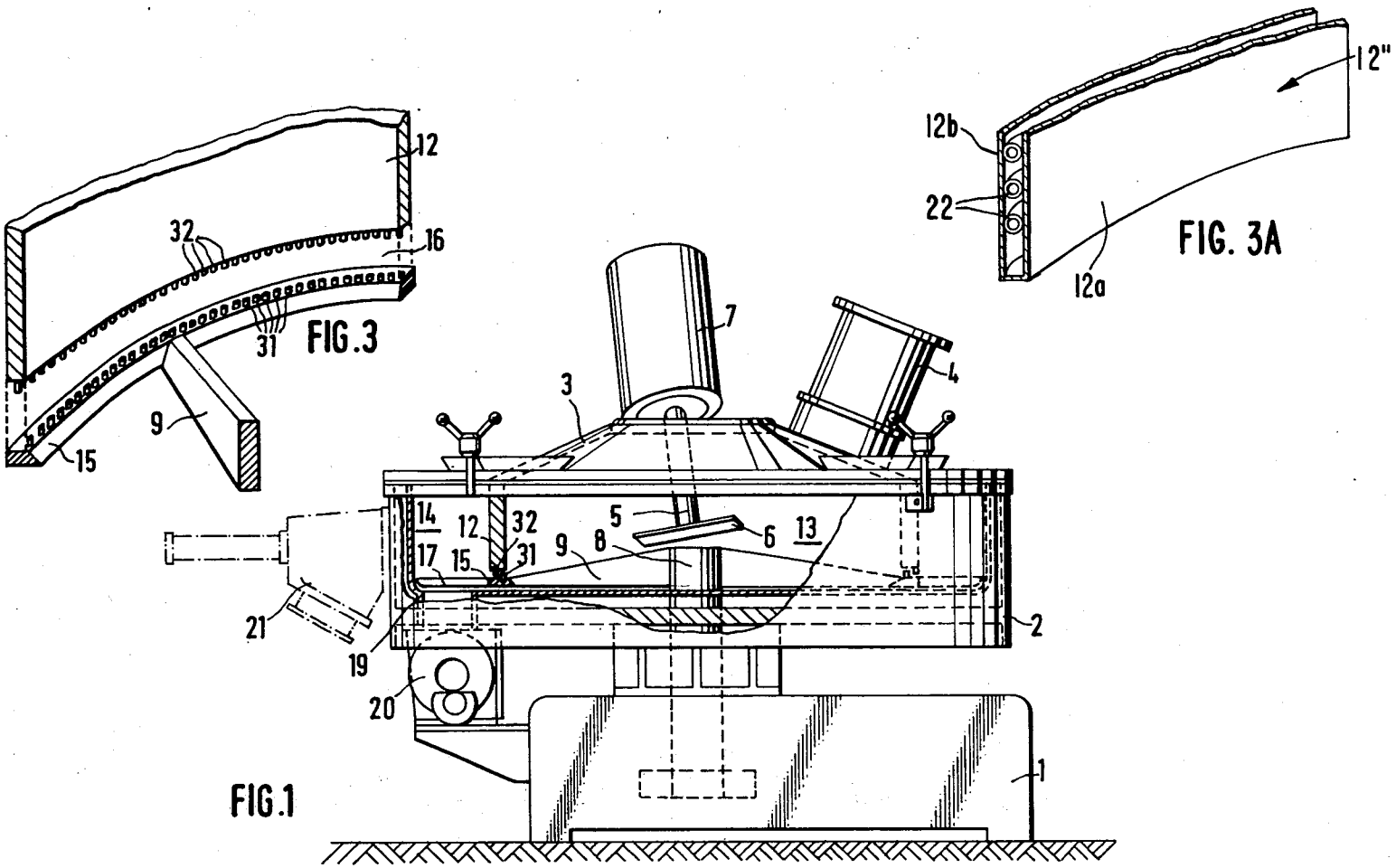
FIG. 1 shows a cooling mixer in a vertical view, partly broken away.
FIG. 3 is an enlarged partial view of the ring wall and of the rotor ring in an exploded condition.
FIG. 3A is a view corresponding to FIG. 3 but showing a different embodiment of the ring wall.
Figure 2:
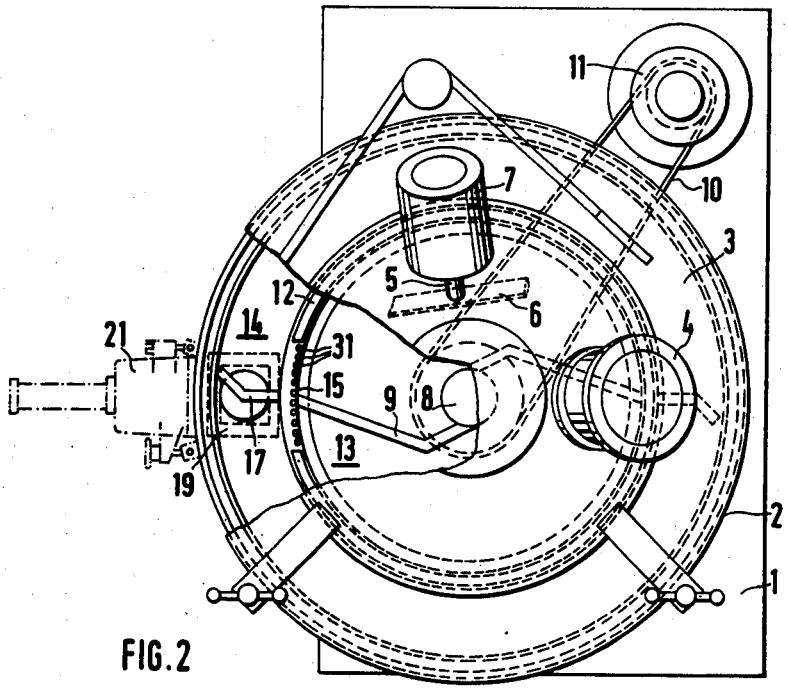
FIG. 2 a plan view in regard to FIG. 1.

On a support block 1 there is mounted a cylindrical mixing container 2 having vertical axis. The mixing container 2 is closed on its upper side by a cover 3 which supports a feeding nozzle 4; the discharging nozzle of a heating mixer, not shown, is connected thereto. The walls of the mixing container 2 and/or of the cover 3 are provided as double walls and enclose in each case coolant lines. Furthermore, there is supported in the cover 3 a shaft 5 being tilted in regard to the axis of the container; a comminution blade 6 is attached to the shaft which is driven by a motor 7.

An agitator shaft 8 which carries stirring wings 9 near the bottom of container 2 is incorporated by being passed through the bottom wall of the mixing container 2. The agitator shaft 8 is driven by a drive motor 11 by means of a driving belt 10.

A ring wall 12 is secured to the cover 3. The ring wall 12 may also be provided as a double wall containing a cooling device. The ring wall 12 separates the interior of the mixing container into an interior space 13 and into an outer annular space 14. There is approximately the same volume for each of these two spaces. A rotor ring 15 which is located beneath the ring wall 12 and which limits and defines therewith a gap 16, is attached to the stirring wings. Ring 15 is radially spaced from shaft 8. The stirring wings 9 extend in the form of arms 17 into the annular space 14.

Pins 31 are provided in a row on the ring 15 which pins cover the opening of the gap 16 and thus define a comb-like opening of the gap. Passage openings having rectangular cross-section are thus provided between the pins 31. Also at the lower side of the ring wall 12, there are provided pins 32 in a ring-shaped arrangement which likewise overlap the width of the gap 16. FIG. 3 shows, on an enlarged scale, these conditions within gap 16 in more detail, for clarity showing the ring wall 12 in exploded view drawn away upwards relative to the rotor ring 15. In the assembled condition, the pins 31 and 32 substantially completely overlap the width (between the bottom edge of ring wall 12 and the top edge of rotor ring 15) of the gap 16.

The discharging of the cooling mixer is associated with the annular space 14. On the one hand, a discharge opening 19 near the bottom or at the bottom which cooperates with a discharge sluice 20 may be provided. On the other hand, it is also possible to provide a discharge slide or valve 21 which is drawn in the Figure in dot-dash lines.

The mixture, previously heated up within a heating mixer, so that the temperature of the mixture is within the softening range of the thermoplast, is added in a batchwise manner via the feeding nozzle 4 into the interior space 13. As compared with the volume of the mixture, the interior space 13 has a relatively small cooling surface. The temperature of the coolant is adjusted in such a manner that within the interior space 13 a cooling is performed to a temperature at the lower limit of the softening range. Consequently, the comminution blade 6 within the interior space 13 is fully effective to granulate the materials. Such agglomerates or granulated materials, the particle size of which is smaller than the openings between the pins 31 and/or pins 32, respectively, are allowed to enter the outer annular space 14 through gap 16 by action of wings 9. The crown-shaped configurations of the pins 31 and 32 thus guarantee complete control and supervision of the size of the granules passing through gap 16.

Within the outer annular space 14 intensive cooling is carried out, particularly due to the fact that the surface of this outer annular space 14, as compared with its volume, is considerably larger than in the case of the interior space 13. Consequently, the temperature of the agglomerates is immediately decreased in the outer annular space 14 below the lower limit of the softening range so that the agglomerates solidify and so that there is no danger of further agglomeration. Thus, only agglomerates of a regulated particle size are available within the outer annular space. Consequently, a granulate having uniform particle size is obtained in the outer annular space. If for example a discharge sluice 20 is used, the discharge of the agglomerate can be carried out continuously with a constant discharge quantity per unit of time, securing at a constant cooling capacity the constant outlet temperature as required. Thus, the cooling mixer according to the invention, in spite of batchwise feeding, enables a continuous discharge. This is achieved primarily by the partition of the mixing container into an interior space serving as a buffering or stockpiling space and into an outer annular space as a discharge space by means of ring wall 12 and ring 15. The interior space 13 is adapted as a buffering space to receive a complete charge of the heating mixer which charge, in the measure of the size reduction, is passed into the outer annular space 14 and which is continuously discharged after cooling to the end temperature.

FIG. 3A shows an alternate embodiment of the ring wall, in which a ring wall 12' is a double wall having sides **12*a* and 12*b* spaced apart to contain therebetween conduits 22 which serve to carry coolant therethrough. Side walls 12*a*, 12*b*** join to define a bottom edge (unnumbered). Obviously, other selected portions of the container may be similarly made of double walls for cooling purposes.

When processing soft PVC, a cooling temperature in the interior space of approximately 70° C. and a cooling temperature in the outer annular space of approximately 45° C. are provided. These temperatures are, of course, adjusted to the particular thermoplastic as processed, and must take into account, above all, the lower limit of the softening range of the specific thermoplast-mixture. The size of the granuli is determined by the adjusting of the gap width.

In the case of the embodiment as illustrated the pin crown is provided on the upper end on the rotor ring 15. Moreover, the pin crown may be provided on the lower side of the rotor ring so that a gap beneath the rotor ring is formed.

What is claimed is:

1. A continuous mixing apparatus comprising:

a. a mixing container having a container bottom;

b. a concentric ring wall disposed within said container and dividing it into an interior space whose outer periphery is defined by said ring wall and an outer annular space whose inner periphery is defined by said ring wall, said ring wall terminating in a bottom edge thereof disposed above said container bottom;

c. a feeding nozzle in flow communication with said interior space to introduce mixture components therein;

d. discharge opening means leading from said outer annular space;

e. a central agitator shaft supporting mixing wings for rotation within said interior space adjacent said container bottom;

f. a rotor ring carried by said mixing wings at a location radially spaced from said agitator shaft and disposed adjacent said bottom edge of said ring wall to define therewith a gap of selected width disposed above said container bottom and radially spaced from said shaft whereby mixture particles of a size not greater than said width of said gap are passed, by rotation of said wings, from said interior space to said outer annular space for removal therefrom via said discharge opening.

2. The apparatus of claim 1 wherein said gap has a comb-like configuration defined by vertically projecting members projecting across said gap.

3. The apparatus of claim 2 wherein said vertically projecting members are pin shaped members, a plurality of which project upwardly from the top edge of said rotor ring and another plurality of which project downwardly from said bottom edge of said ring wall.

4. The apparatus of claim 2 wherein said vertically projecting members divide said gap into individual passages of rectangular cross sections.

5. The apparatus of claim 1 wherein said gap is formed between the bottom edge of said ring wall and the top edge of said rotor ring.

6. The apparatus of claim 1 wherein said container is defined, at least in part, by double walls and means are provided to pass a coolant within said double walls.

7. The apparatus of claim 1 wherein said ring wall is a double wall ring wall having means therein to pass a coolant therethrough.

8. The apparatus of claim 1 wherein said wings have at their outer ends arms which extend into said outer annular space.

9. The apparatus of claim 1 wherein the volume of said interior space is approximately equal to the volume of said annular outer space.

10. The apparatus of claim 1 further including a separate shaft having comminution blades and projecting into said interior space to dispose said comminution blades therein.

11. A continuous mixing-cooling apparatus comprising:

a. a mixing container having a container bottom;

b. a concentric ring wall disposed within said container and dividing it into an interior space whose outer periphery is defined by said ring wall and an outer annular space whose inner periphery is defined by said ring wall, said ring wall terminating in a bottom edge thereof disposed above said container bottom and containing means to pass a coolant therethrough;

c. a feeding nozzle in flow communication with said interior space to introduce mixture components therein;

d. discharge opening means leading from said outer annular space;

e. a central agitator shaft supporting mixing wings for rotation within said interior space adjacent said container bottom;

f. a rotor ring carried by said mixing wings at a location radially spaced from said central shaft and disposed adjacent said bottom edge of said ring wall to define therewith a gap of selected width between said rotor ring and said bottom edge of said ring wall, said gap being radially spaced from said shaft; and g. a plurality of vertically projecting members supported on at least one of said rotor ring and said bottom edge of said ring wall and disposed along the periphery thereof to project across said gap in a comb-like configuration whereby only mixture particles of a size not greater than said width of said gaps are passed, by rotation of said wings, from said interior space to said outer annular space for removal therefrom via said discharge opening.

12. The apparatus of claim 11 wherein the volume of said interior space is substantially equal to the volume of said outer annular space.

* * * * *